US008251676B2

(12) United States Patent
Fleischmann et al.

(10) Patent No.: US 8,251,676 B2
(45) Date of Patent: Aug. 28, 2012

(54) AXIAL-FLOW FAN FOR A VEHICLE RADIATOR

(75) Inventors: Karl-Heinz Fleischmann, Marienwerder (DE); Stefan Berg, Berlin (DE); Alexander Gass, Berlin (DE)

(73) Assignee: Brose Fahrzeugteile GmbH & Co. Kommanditgesellschaft, Würzburg, Würzburg (DE)

( * ) Notice: Subject to any disclaimer, the term of this patent is extended or adjusted under 35 U.S.C. 154(b) by 348 days.

(21) Appl. No.: 12/515,960

(22) PCT Filed: Nov. 15, 2007

(86) PCT No.: PCT/DE2007/002068

§ 371 (c)(1),
(2), (4) Date: Sep. 14, 2009

(87) PCT Pub. No.: WO2008/061502

PCT Pub. Date: May 29, 2008

(65) Prior Publication Data

US 2010/0054968 A1 Mar. 4, 2010

(30) Foreign Application Priority Data

Nov. 24, 2006 (DE) ..... 10 2006 055 452

(51) Int. Cl.

| | |
|---|---|
| ***F04B 17/00*** | (2006.01) |
| ***F04B 35/00*** | (2006.01) |
| ***F04B 39/06*** | (2006.01) |
| ***F04B 39/02*** | (2006.01) |
| ***H02K 9/00*** | (2006.01) |
| ***H02K 9/06*** | (2006.01) |
| ***F01D 5/06*** | (2006.01) |
| ***F01D 1/04*** | (2006.01) |
| ***F03B 3/04*** | (2006.01) |
| ***F03D 11/00*** | (2006.01) |
| ***F04D 3/00*** | (2006.01) |
| ***F04D 19/00*** | (2006.01) |
| ***F04D 29/32*** | (2006.01) |

(52) U.S. Cl. ..... 417/368; 417/371; 310/62; 415/79

(58) Field of Classification Search ..... 417/366, 417/368–371, 423.7; 310/62; 415/77, 79; 416/169 A, 175

See application file for complete search history.

(56) References Cited

U.S. PATENT DOCUMENTS 3,826,193 A * 7/1974 Rognmo et al. ..... 102/208

(Continued)

FOREIGN PATENT DOCUMENTS

EP 1050682 A2 11/2000

(Continued)

OTHER PUBLICATIONS

International Search Report in PCT/DE2007/002068 Dated Mar. 17, 2008.

*Primary Examiner* — Devon Kramer
*Assistant Examiner* — Thomas Fink
(74) *Attorney, Agent, or Firm* — Manelli Selter PLLC; Edward J. Stemberger

(57) ABSTRACT

An axial-flow fan for a vehicle radiator includes a fan wheel that delivers the main air flow and is driven by a hub motor coupled to the fan wheel. The vehicle radiator is on the intake side of the fan wheel, the hub motor during operation is cooled by a secondary air flow, and the cooling air flow of the hub motor flowing out from an air outlet opening is on the intake side in the hub area of the fan wheel. An air baffle device including a propeller is assigned to the hub motor and the cooling air flow passing through the air baffle device is led out of the air outlet opening, avoiding disturbances of the main air flow delivered by the fan wheel.

8 Claims, 2 Drawing Sheets

U.S. PATENT DOCUMENTS

Figure 1:
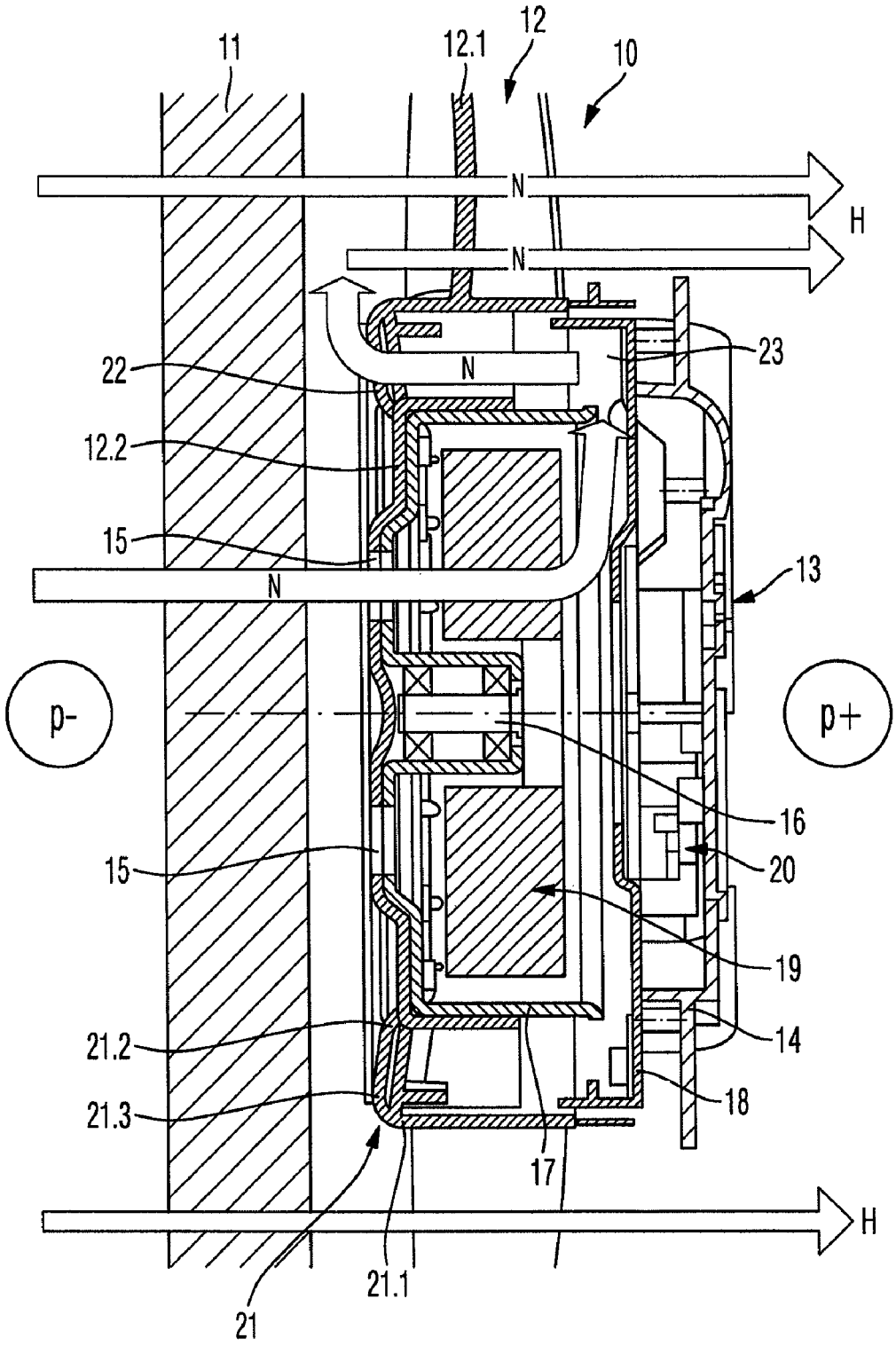

| | | | | |
|---|---|---|---|---|
| 4,210,833 | A | 7/1980 | Neveux | |
| 4,958,988 | A * | 9/1990 | Regev | 417/53 |
| 5,814,908 | A * | 9/1998 | Muszynski | 310/62 |
| 5,967,764 | A * | 10/1999 | Booth et al. | 417/423.8 |
| 6,364,004 | B1 * | 4/2002 | Ehrmann et al. | 165/125 |
| 6,682,320 | B2 * | 1/2004 | Gold et al. | 417/368 |
| 7,122,924 | B2 * | 10/2006 | Lee | 310/62 |
| 2004/0223845 | A1 * | 11/2004 | Caplan et al. | 415/173.1 |
| 2006/0280625 | A1 * | 12/2006 | Moreau | 417/366 |

FOREIGN PATENT DOCUMENTS

| | | |
|---|---|---|
| WO | 92/10682 | 6/1992 |

* cited by examiner

AXIAL-FLOW FAN FOR A VEHICLE RADIATOR

The invention relates to an axial-flow fan for a vehicle radiator of the type specified in the preamble of claim 1.

Electric motors, particularly those which have their maximum power output and hence also their greatest degree of self-heating at high ambient temperatures, are used to drive such axial-flow fans, which are capable of generating a cooling air flow in a cross-flow radiator of a motor vehicle internal combustion engine. The problem arises, particularly in the case of electrical fans having a large hub diameter and an axial-flow fan wheel arranged on the intake side, that the electric motor, usually arranged in the hub, has only an insufficient air flow passing through it. It is common, in this context, for a cooling air flow to be conducted axially through the hub motor, in order to reduce the self-heating of the electric motor and consequently also to increase the service life whilst at the same time improving the output. If corresponding passages for cooling air are provided at the ends of the electric motor, this inevitably results in a 'short-circuit' between the delivery side and the intake side of the fan wheel, that is to say, owing to the pressure gradient, the cooling air flows from the delivery side to the intake side, counter to the main air flow of the axial-flow fan, and in so doing may result in an adequate axial flow of cooling air through the electric motor. A Disadvantage that has to be taken into account here, however, is the fact that the fan efficiency may be considerably reduced owing to the air ducting.

The object of the invention is to specify an axial-flow fan for a vehicle radiator of the type specified in the preamble of claim 1, which whilst avoiding any significant reduction in the efficiency of the fan is capable of affording a sufficient flow of air for cooing the hub motor.

According to the invention, the object is achieved by the features of claim 1.

Advantageous developments of the invention form the subject matter of the dependent claims.

The basic idea of the invention is based on the notion that it is possible to bring the secondary air flow for cooling the hub motor and the main air flow delivered by the fan wheel largely into conformity. The direction of flow of the main air flow and that of the secondary air flow led through the hub motor for cooling the motor then coincide. This at least partly coincident direction of flow of the main air flow and the secondary air flow produces an efficient cooling of the hub motor. In the state of the art the axial flow of cooling air through the hub motor is usually achieved via the pressure equalizing flow from the delivery side to the intake side of the axial-flow fan. Such a conventional secondary air flow in the opposite direction to the main air flow reduces the pressure and volumetric flow attainable by the main air flow. For that reason the efficiency of the axial-flow fan is reduced. In order to avoid such a reduction in the efficiency, an equidirectional flow through the motor is provided with the main air flow and the secondary air flow oriented in the same direction. For this purpose an air baffle device is provided on the intake side of the fan motor, via which the secondary air flow can be delivered to the hub motor on the intake side and, at least in some areas, flows through said motor in a direction of flow coincident with the direction of flow of the main air flow. The air baffle device is formed, for example, by a suitable configuration of the hub, which brings the secondary air flow into line with the main air flow.

Although the axial-flow fan according to the invention has been developed for vehicle radiators having very sophisticated fluid mechanics owing to the problems of headwind, it could also be readily used with other vehicle heat exchangers or even with stationary heat exchangers having a similar problem and the hub motor of which requires air cooling.

In an advantageous development of the invention a rotating air delivery device, which draws the cooling air flow of the hub motor in through at least one and preferably through a plurality of air inlet openings situated on the intake side in the hub area of the fan wheel and expels it again at the air outlet opening situated at a radial distance therefrom, is provided as air baffle device. The air inlet opening, the inlet cross section of which can also be provided by multiple openings together, is in this case situated as centrally as possible in the hub end face, whilst the air outlet opening is likewise located on the hub end face in an edge area of the hub motor close to the circumference. The cooling air on the intake side therefore passes into the motor through air inlet openings situated in the hub area close to the axis and is led out through air baffle devices on the hub periphery, in particular air outlet openings on the intake side. The corresponding openings are connected together via a flow path, which is situated inside the hub motor and is formed by the components to be cooled, with axial and radial path sections to a cooling air duct. With this air ducting the air flow for cooling the hub motor scarcely affects the fan efficiency, since there is no inlet opening for the cooling air flow on the delivery side of the fan wheel and therefore no 'short circuit' can occur between the excess pressure side and the negative pressure side of the fan wheel. Instead the delivery capacity of the air delivery device is designed so as to generate a cooling air flow that is just sufficient for cooling the hub motor.

Since only a relatively small cooling air flow needs to be delivered, therefore, a propeller having a low power demand and blades distributed around the circumference may be provided as air delivery device, the propeller being arranged in the area of an annular air outlet opening and drawing the cooling air from the central area of the hub end face through the cooling air duct inside the hub motor before expelling it again in the edge area on the hub end face close to the circumference.

An air delivery device of especially simple design construction is feasible if the propeller is embodied as an impeller rotating together with the fan wheel and preferably integrally formed with the fan wheel of the axial-flow fan.

An especially stable integration of the impeller into the fan wheel can be achieved if the impeller comprises a plurality of radially extending blades distributed over its circumference, the inner ends of which blades are each connected to an inner ring and the outer ends of which are each connected to an outer ring of the impeller.

A brushless electric motor is especially well-suited as hub motor, since it allows a simplified cooling air ducting, using components of the electric motor for the flow path of the cooling air duct.

A system of multiple slit-shaped air inlet openings is preferably grouped around a central bearing seat of the rotor in the central area of the hub motor as air inlet opening for the cooling air, the air inlet openings running radially in a star-shaped overall arrangement. This affords a sufficient overall intake cross section and the hub area is not unduly weakened in the connection to the bearing area.

A further advantage for the cooling air ducting can be obtained through the use of an external rotor motor as hub motor. In this case an annular gap, which leads to an increased flow resistance between the delivery side and the intake side, may be formed in the hub area between the rotating components and the static components. The increased flow resistance serves to prevent a secondary air flow in opposition to the main air flow. At the same time the air flowing through the hub motor is deflected.

Figure 2:
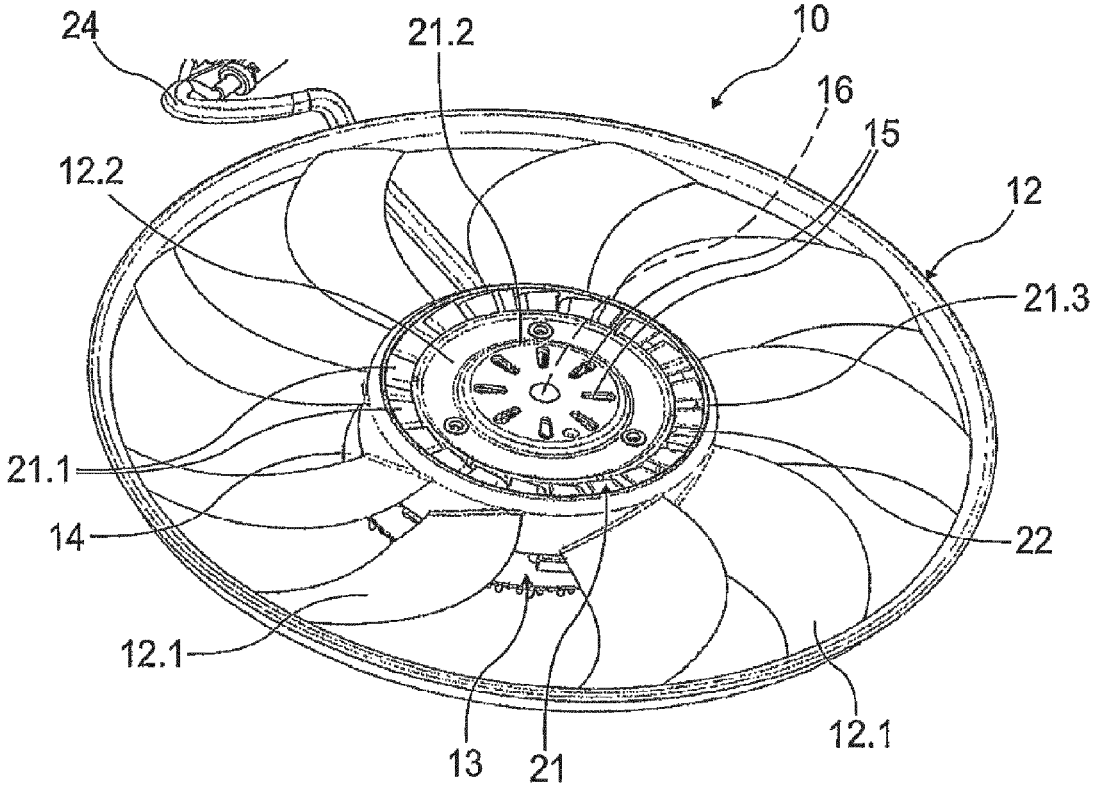

An exemplary embodiment of the invention will be explained in more detail below with reference to a drawing, in which:

FIG. 1 shows a diagonal section through a hub area of an axial-flow fan in the installed position and FIG. 2 shows a perspective, detailed view of the axial-flow fan according to FIG. 1.

FIG. 1 shows a central area of an axial-flow fan 10, drawn with break lines cut away and having a horizontal axis of rotation and a vertical plane of rotation, which is located a short interval behind a broad side of a vehicle radiator 11. The plane of rotation of the axial-flow fan 10 here runs substantially parallel to the rear broad side of the radiator 11, since this is embodied as a flat-parallel cross-flow radiator.

The axial-flow fan 10 usually serves, when the flow of headwind through the radiator 11 is insufficient, to bring about a flow through the radiator 11 sufficient to cool the coolant with a cooling air flow generated by rotation of its fan wheel 12 and a direction of flow corresponding to that of the headwind. For this purpose the fan wheel 12 is driven to rotate clockwise by a hub motor 13 centrally arranged in the fan wheel 12, so that the intake flow, that is to say the main air flow H, of the fan wheel 12 flows through the radiator 11.

The intake side of the axial-flow fan 10 is denoted by p− and its delivery side by p+ in order to illustrate the relative pressures. The main air flow H is furthermore channeled by a fan hood (not shown), which forms an airtight enclosure for the flow path between the rectangular periphery of the radiator 11 and the circular outlet opening of a fan casing accommodating the fan wheel 12. In the circular outlet opening of the fan casing, a hub housing 14, to which the hub motor 13 is coaxially attached, is centered and immovably held by said casing in the usual manner, for example by radial struts.

As can be seen in conjunction with the general representation of the fan wheel 12 in FIG. 2, the hub housing 14 carrying the hub motor 13 extends over approximately one third of the fan wheel diameter and covers a correspondingly large area of the radiator 11. In the overlap area with the hub motor 13 the proportion of the main air flow H, which is drawn through the radiator 11 by the blades 12.1 situated on the circumference of the of the hub motor 13, is low owing to the 90° deflection that is required. Despite this, the high axial flow velocity at the hub circumference, among other things, here helps to create an area of low pressure, compared to the delivery side p+ of the axial-flow fan 10, so that the pressure gradient forming with the hitherto usually open construction of the hub motor 13 causes the air to flow back from the delivery side p+ to the intake side p−. Although the resulting volumetric flow on the one hand cools the components of the hub motor 13 and thereby improves the efficiency of the electric hub motor 13 at high ambient temperatures, on the other hand it leads to a loss of volumetric flow and a smaller increase in the pressure on the delivery side p+ and consequently to a reduction in the efficiency of the axial-flow fan.

In order to be able to improve the electrical efficiency of the hub motor 13 through air cooling, without leading to significant disturbance of the main air flow generated by the fan wheel 12, the hub motor 13 is provided with cooling air ducting which is largely adapted to the ducting of the main air flow H and which in the form of an at least partly coincident secondary air flow N is nevertheless capable of ensuring a sufficient flow of air through the hub motor 13. For this purpose multiple, elongate, radially running air inlet openings 15, which are grouped in a uniform distribution about a central bearing seat of the hub motor 13, are cut out of the end face in the central area of the hub motor 13 close to the axis of rotation. The air inlet openings 15 also pass through a hub plate 12.2 of the fan wheel 12, which is fixed by three bolted points to the end face of a canister-shaped rotor housing 17 of the hub motor 13. The rotor housing 17 carrying the permanent magnets is supported on a bearing pin 16, which protrudes from a similarly canister-shaped stator housing 18, by a central bearing sleeve, situated between the air inlet openings 15, and two roller bearings. The stator housing 18 carrying the stator with motor winding 19 is in turn firmly connected to the hub housing 14.

The hub motor 13 comprising the rotor housing 17 and the stator housing 18 is embodied as a direct-current external rotor motor and does not have any contact brushes, as it is commutated electronically. The components for electronic commutation of the hub motor 13 are protected—along with any other electronic components—inside the hub housing 14, which is composed of a lightweight metal such as aluminum and affords good heat dissipation. Arranging these elements in the hub housing 14 not only affords a more compact construction of the hub motor 13 but also simplifies the air ducting of the cooling air flow inside the hub motor 13.

Formed onto the hub plate 12.2 in front of the transitional area between the hub plate 12.2 and the hub circumferential face of the fan wheel 12 is an impeller 21, which is integrally formed from plastic with the fan wheel 12 and has a plurality of radially extending blades 21.1 distributed around its circumference, the inner ends of which blades are each connected to an inner ring 21.2 and the outer ends of which are each connected to an outer ring 21.3 of the impeller 21. The impeller 21 is thereby stably incorporated into the assembly of the fan wheel 12 and generates little or no vibration. The blades 21.1 of the impeller 21 cover an air outlet opening 22 of an annular overall shape, from which the cooling air of the fan motor 13 can flow out axially. An axial duct section inside the hub motor 13 situated downstream of the outlet opening 22 is closed at the outer circumference by a circumferential wall, from which the blades 12.1 of the fan wheel 12 project. This circumferential wall extends just up to the hub housing 14 and is a small circumferential distance short of longitudinally overlapping the circumferential wall of the stator housing 18 protruding in the opposite direction.

The fan wheel 12, stator housing 18 and rotor housing 17 therefore together define a cooling air duct 23, the flow path of which illustrated by flow arrows comprises one radial path section and two axial path sections. If the hub motor 13, which is connected via a wiring harness 24 to the electrical system of the motor vehicle, is correspondingly actuated or wired, the fan wheel 12 is driven to rotate by the hub motor 13 and generates the desired main air flow H for the cross flow airstream through the vehicle radiator 11. The impeller 21 is at the same time turned by the fan wheel 12 and generates an intake flow in the cooling air duct 23. This intake flow causes the secondary air flow N for cooling the hub motor 13 to be drawn in via the air inlet openings 15, the intake air flow being led through the opposing face area of the radiator 11. Once the cooling air flow has entered the air inlet openings 15, the cooling air first flows in the main axially up to the opposing end wall of the stator housing 18 and is then drawn radially via the gap between the canister edge of the rotor housing 17 and the opposing end wall of the stator housing 18, and then drawn in the opposite direction to the inflow direction axially to the impeller 21, before the cooling air flow leaves the hub motor 13 again through the air outlet opening 22. The emerging cooling air flow is less resistant to compression and can therefore be deflected radially from the main air flow H of the fan wheel 12 without significant turbulence, and consequently delivered to the blades 12.1 of the fan wheel 12.

LIST OF REFERENCE NUMERALS

10 axial-flow fan
11 vehicle radiator
12 fan wheel
12.1 blade
12.2 hub plate
13 hub motor
14 hub housing
15 air inlet opening
16 bearing pin
17 rotor housing
18 stator housing
19 stator with motor winding
20 components (electronic)
21 impeller
21.1 blade
21.2 inner ring
21.3 outer ring
22 air outlet opening
23 cooling air duct
24 cable harness
H main air flow
N secondary air flow
p+ delivery side
p− intake side

The invention claimed is:

1. An axial-flow fan (10) for a vehicle radiator (11), a fan wheel (12) of which delivers a main air flow (H) is driven by a hub motor (13) centrally rotationally coupled to said fan wheel, the vehicle radiator (11) being arranged on an intake side of the fan wheel (12), the hub motor (13) during operation being cooled by a secondary air flow, and the secondary air flow of the hub motor (13) flowing out from an air outlet opening (22) situated on the intake side of the fan wheel in a hub end face of the fan wheel (12), the axial flow fan comprising: an air baffle device provided in the hub end face of the fan wheel on the intake side of the fan wheel (12), via which the secondary air flow (N) can be drawn through the hub motor (13) from the intake side of the fan wheel and, at least in some areas, the secondary air flow flows through said hub motor in a direction of flow coincident with the direction of flow of the main air flow (H), the air baffle device being an air delivery device generating the secondary air flow through the hub motor (13) through rotation, which draws the secondary air flow in through at least one air inlet opening (15) situated on the intake side of the fan wheel in a central area of the hub end face of the fan wheel (12), the air outlet opening (22) being of substantially annular shape and being oriented to face substantially opposite the direction of the main air flow, wherein the air delivery device is a propeller having multiple blades (21.1) that turn when the hub motor (13) is running, the propeller being arranged to overlap the air outlet opening (22), wherein the propeller is configured to draw the secondary air flow from the central area of the hub end face through the at least one air inlet opening at the intake side of the fan wheel, then through a cooling air duct (23) inside the hub motor on an exhaust side of the fan wheel and to expel the secondary air flow through the air outlet opening in an edge area on the hub end face close to the circumference on the intake side of the fan wheel.

2. The axial-flow fan as claimed in claim 1, wherein each air inlet opening (15) assigned to the air delivery device is arranged in a central area of the hub motor (13) and each air outlet opening (22) thereof is arranged in an edge area of the hub motor (13) close to the circumference, the air inlet opening (15) and associated air outlet opening (22) being connected together via a flow path with axial flow path sections and at least one radial path section to the forced-draft ventilated cooling air duct (23).

3. The axial-flow fan as claimed in claim 1, wherein the propeller is embodied as an impeller (21) rotating with the fan wheel (12).

4. The axial-flow fan as claimed in claim 3, wherein the impeller (21) is integrally formed with the fan wheel (12).

5. The axial-flow fan as claimed in claim 3, wherein the impeller (21) comprises a plurality of radially extending blades (21.1) distributed over its circumference, the inner ends of which blades are each connected to an inner ring (21.2) and the outer ends of which are each connected to an outer ring (21.3) of the impeller (21).

6. The axial-flow fan as claimed in claim 2, wherein the hub motor (13) is a brushless electric motor, components of which define a flow path of the cooling air duct (23).

7. The axial-flow fan as claimed in claim 2, wherein in the central area of the hub motor (13) multiple radially running air inlet openings (15) are arranged around a central bearing seat of the hub motor (13).

8. The axial-flow fan as claimed in claim 2, wherein the hub motor (13) is embodied as an external rotor motor.

* * * * *